US009728053B2

(12) United States Patent
Napthine

(10) Patent No.: US 9,728,053 B2
(45) Date of Patent: Aug. 8, 2017

(54) SECURITY DEVICE

(71) Applicant: SEKURA GLOBAL LLP, Manningtree (GB)

(72) Inventor: Russell Napthine, Manningtree (GB)

(73) Assignee: Sekura Global LLP, Manningtree (GB)

( * ) Notice: Subject to any disclaimer, the term of this patent is extended or adjusted under 35 U.S.C. 154(b) by 0 days.

(21) Appl. No.: 14/897,092

(22) PCT Filed: Jun. 11, 2014

(86) PCT No.: PCT/GB2014/051795
§ 371 (c)(1),
(2) Date: Dec. 9, 2015

(87) PCT Pub. No.: WO2014/199153
PCT Pub. Date: Dec. 18, 2014

(65) Prior Publication Data

US 2016/0125712 A1 May 5, 2016

(30) Foreign Application Priority Data

Jun. 11, 2013 (GB) ..... 1310381.7

(51) Int. Cl.
*G08B 13/12* (2006.01)
*E05B 45/00* (2006.01)
(Continued)

(52) U.S. Cl.
CPC ..... *G08B 13/12* (2013.01); *E05B 45/005* (2013.01); *E05B 73/0029* (2013.01);
(Continued)

(58) Field of Classification Search
CPC . G08B 13/12; Y10T 70/5004; Y10T 70/5009; E05B 45/005; E05B 73/0005;
(Continued)

(56) References Cited

U.S. PATENT DOCUMENTS 3,906,758 A 9/1975 Hurwitt
4,086,795 A 5/1978 Foster et al.
(Continued)

FOREIGN PATENT DOCUMENTS

WO 2006/040693 4/2006
WO 2011/143529 11/2011
WO 2012/068822 5/2012

OTHER PUBLICATIONS

International Search Report and Written Opinion of the International Searching Authority bearing a mailing date of Oct. 16, 2014, 14 pages.

(Continued)

*Primary Examiner* — Hung T Nguyen
(74) *Attorney, Agent, or Firm* — Burr & Brown, PLLC

(57) ABSTRACT

A security device for preventing or deterring theft of an object from a retail store or similar comprising a housing; a loop of cable extending from the housing for placement around said object; spool means rotatably mounted on the housing, the loop of cable being attached to the spool means such that, in use, rotation of the spool means in a first direction with respect to the housing causes the cable to unwind from the spool means, and rotation of the spool means in a second direction causes the cable to be wound around the spool means; latching means; alarm means; and retracting means arranged to apply a biasing force to the spool means.

15 Claims, 3 Drawing Sheets

(51) Int. Cl.
*E05B 73/00* (2006.01)
*E05B 15/04* (2006.01)
*G08B 13/24* (2006.01)

(52) U.S. Cl.
CPC ..... *E05B 73/0052* (2013.01); *E05B 2015/042* (2013.01); *E05B 2015/0448* (2013.01); *G08B 13/2434* (2013.01)

(58) Field of Classification Search
CPC . E05B 67/006; E05B 73/0029; E05B 73/0017
USPC ..... 340/568.1, 568.2, 572.8, 572.9, 571; 70/15, 18, 49, 57.1, 58, 63
See application file for complete search history.

(56) References Cited

U.S. PATENT DOCUMENTS

| | | | | |
|---|---|---|---|---|
| 4,543,806 | A | 10/1985 | Papandrea et al. | |
| 5,408,212 | A | 4/1995 | Meyers et al. | |
| 5,960,652 | A | 10/1999 | Marmstad | |
| 2006/0137409 | A1* | 6/2006 | Fawcett | E05B 45/005 70/57.1 |
| 2009/0223260 | A1 | 9/2009 | Conti et al. | |
| 2010/0101283 | A1 | 4/2010 | Xiaobin | |
| 2010/0139336 | A1 | 6/2010 | Necchi | |
| 2011/0102179 | A1* | 5/2011 | Ezzo | E05B 73/0017 340/568.1 |
| 2012/0227447 | A1 | 9/2012 | Conti | |
| 2013/0067968 | A1 | 3/2013 | Ezzo | |

OTHER PUBLICATIONS

GB Search Report bearing a mailing date of Oct. 28, 2013, 2 pages.

* cited by examiner

SECURITY DEVICE

BACKGROUND a. Field of the Invention

This invention relates to a security device for preventing or deterring theft of an article from a retail store or similar. In particular this invention relates to a security device that may be wrapped around an article to prevent or deter a person from tampering with the article or removing the article from the store.

b. Related Art

There are a number of known systems for deterring or preventing theft of articles from a retail space. Typically these systems include an electronic article surveillance (EAS) tag that is attached to the article or object in the retail store. While the EAS tag is activated, the tag is arranged to trigger an alarm if the tag, and therefore the article, passes between a pair of detection gates, which are typically positioned at the entrance and exit of the retail store.

When a customer purchases an article having one of these EAS tags attached to it, the tag is deactivated so that the alarm is not triggered when that person leaves the retail store.

In some systems the tag remains attached to the article, for example when the tag is in the form of a label stuck to the packaging. In other systems the tag is deactivated and removed completely from the article. These systems tend to be referred to as hard tags, and are re-usable.

There are a number of different ways of attaching hard tags to articles, and which one is used will typically depend on the type of article being tagged. For clothing, the usual method of attaching a tag is by piercing the clothing with a pin, the sharp end of the pin being engaged with the tag body once it has pierced through the clothing. This method of attaching a tag, however, is only suitable for articles where both sides of the article are accessible, and which can be pierced.

Another known way to attach a hard EAS tag to an article is to use cables that pass around the article. Typically in these systems, the cables are tightened around the article and then the tag is activated. Once activated, the cables cannot be loosened or cut without triggering an alarm, thereby preventing unauthorised removal of the tag from the object.

One of the problems with re-usable hard tag systems is the time taken to install the tags on the articles when the articles are placed on display in the retail store, as well as the time taken to remove the tag when an article is purchased by a customer.

It is an object of the present invention to provide an improved security device for deterring theft of an object from a retail space.

SUMMARY OF THE INVENTION

According to the present invention, there is provided a security device for deterring theft of an object, the security device comprising:

a housing;

a loop of cable extending from the housing for placement around said object;

spool means rotatably mounted on the housing, the loop of cable being attached at first and second ends to the spool means such that, in use, rotation of the spool means in a first direction with respect to the housing causes the cable to unwind from the spool means permitting placement of the loop of cable around said object, and rotation of the spool means in a second, opposite direction causes the cable to be wound around the spool means thereby tightening the loop of cable around said object;

latching means movable between a first position in which the spool means is able to rotate freely in both the first and second directions, and a second position in which the spool means is able to rotate in the first direction but is prevented from rotating in the second direction;

alarm means, the alarm means being configured to be activated when the latching means is in the second position; and retracting means arranged to apply a biasing force to the spool means to urge the spool means to rotate in said second direction when the latching means is in the first position.

The retracting means allows the cables of the security device to be automatically retracted or wound up so that it is not necessary for a user to manually wind up the cable either when the security device is placed around an article or when the security device is to be stored.

The security device preferably comprises two loops of cable extending from the housing for placement around said object.

In preferred embodiments the retracting means comprises a spring. More preferably the retracting means comprises a torsional spring. In particularly preferred embodiments the retracting means comprises a flat section coil spring.

The retracting means is typically attached to the spool means and to the housing and arranged to apply a biasing force to the spool means to rotate the spool means in the second direction with respect to the housing.

The retracting means preferably comprises a first end portion attached to the spool means and a second end portion attached to the housing. To simplify assembly of the security device, a shape of a part of the spool means is preferably configured to retain the first end of the retracting means and a shape of a part of the housing is preferably configured to retain the second end of the retracting means. As such, the retracting means may be attached to the spool means and to the housing without requiring additional securing means such as screws or adhesive.

In particularly preferred embodiments the first end portion comprises a first hook portion and the second end portion comprises a second hook portion, the hub portion of the spool means comprises a tab configured to receive the first hook portion, and the housing comprises a tab configured to receive the second hook portion.

Preferably the spool means comprises a cable receiving portion, around which the cable is wound, and a hub portion. The retracting means is preferably connected to the hub portion. Preferably the cable receiving portion and the hub portion are spaced along an axis of rotation of the spool means. This minimises the risk of the cables getting tangled with the retracting means.

The housing preferably comprises a flange, the flange being positioned between a first portion of the housing and a second portion of the housing, and the spool means is supported by the flange for rotation with respect to the housing. As such, no axle or bearings are required to enable rotation of the spool means with respect to the housing. In preferred embodiments the flange defines an aperture and the spool means extends through the aperture such that the cable receiving portion is located in the first portion of the housing and the hub portion of the spool means is located in the second portion of the housing.

Preferably the latching means comprises a ratchet mechanism. The ratchet mechanism typically comprises a ratchet track that is located on the housing and a pawl member that is rotatable with the spool means. In preferred embodiments the latching mechanism comprises biasing means arranged to apply a biasing force to urge the pawl member into engagement with the ratchet track and the biasing force of the retracting means is less than the biasing force of said biasing means of the latching mechanism. In this way, the spool does not rotate under the action of the retracting means when the latching mechanism is in the second position.

In other embodiments the retracting means is arranged to apply a biasing force to rotate the spool means in the second direction when the latching means is in the first or the second position.

In preferred embodiments the security device further comprises a locking mechanism movable between an unlocked position and a locked position, the locking mechanism only being movable into the locked position when the latching mechanism is in the second position. In the locked position, the locking mechanism prevents the latching mechanism returning to the first position. Preferably the locking mechanism is configured to automatically move into the locked position when the latching mechanism is moved into the second position.

BRIEF DESCRIPTION OF THE DRAWINGS

The invention will now be further described by way of example only and with reference to the following drawings, in which.

DETAILED DESCRIPTION

Figure 1:
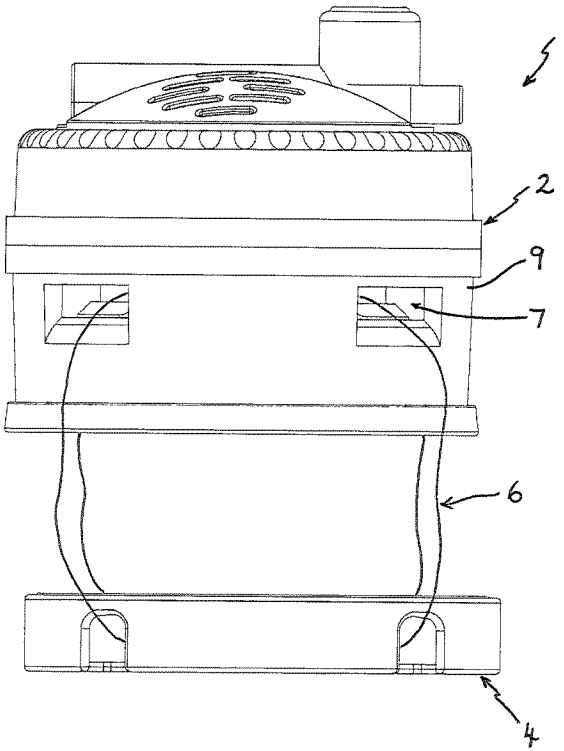
FIG. 1 is a plan view of a security device according to a preferred embodiment of the present invention.

FIG. 1 shows a security device 1 according to a preferred embodiment of the present invention. The security device 1 comprises a main body 2, a guide member 4 and cables 6 that extend between the main body 2 and the guide member 4.

In this example the security device 1 comprises a single cable that is secured at its ends to the main body 2. The cable 6 is looped through the main body 2 and the guide member 4, such that two loops of cable 6 are formed extending between the main body 2 and the guide member 4. The cable 6 is able to pass freely through the guide member 4. In other embodiments the security device may comprise two cables, each being secured at their ends to the main body and passing freely through the guide member, or the security device may comprise four separate cables, each cable being secured at a first end to the main body and at a second end to the guide member.

In all embodiments, therefore, the security device 1 comprises at least one loop of cable 6 secured at first and second ends to the main body 2. In some embodiments the loop of cable 6 is formed of a single continuous length of cable 6, and in other embodiments the loop of cable 6 is formed of two or more cable portions. Each cable portion may extend between the main body 2 and the guide member 4.

The ends of the loops of cable 6 are attached to spool means 8 located within the main body 2 and the cables 6 pass out of the main body 2 through apertures 7 formed in a housing 9 of the main body 2. Rotating the spool means 8 in a first direction causes the cables 6 to be wound around a part of the spool means 8, thereby drawing the guide member 4 towards the main body 2, and shortening the length of cable 6 between the main body 2 and the guide member 4, thereby decreasing the size of the loops. Rotating the spool means 8 in a second, opposite direction unwinds the cables 6 from around the spool means 8, enabling the guide member 4 to be drawn in a direction away from the main body 2, thereby lengthening the cable 6 between the main body 2 and the guide member 4 and increasing the size of the loops.

The security device 1 also includes alarm means. In this embodiment the alarm means comprises an EAS tag and other electronic circuitry (not shown). As described previously, the EAS tag is arranged to trigger an alarm when the security device 1 is activated and the device 1 passes between suitable detection gates. Furthermore, an alarm will be triggered if any of the cables 6 are cut while the security device 1 is activated. The EAS tag may be located in the main body 2 and/or the guide member 4.

In use, with the security device 1 deactivated, the cables 6 are passed around an article to be tagged, such that the article is located between the main body 2 and the guide member 4, with the loops of cable 6 wrapped around the article. Once in position, the security device 1 is then activated to enable the alarm means and prevent removal of the security device 1 from the article.

Figure 2:
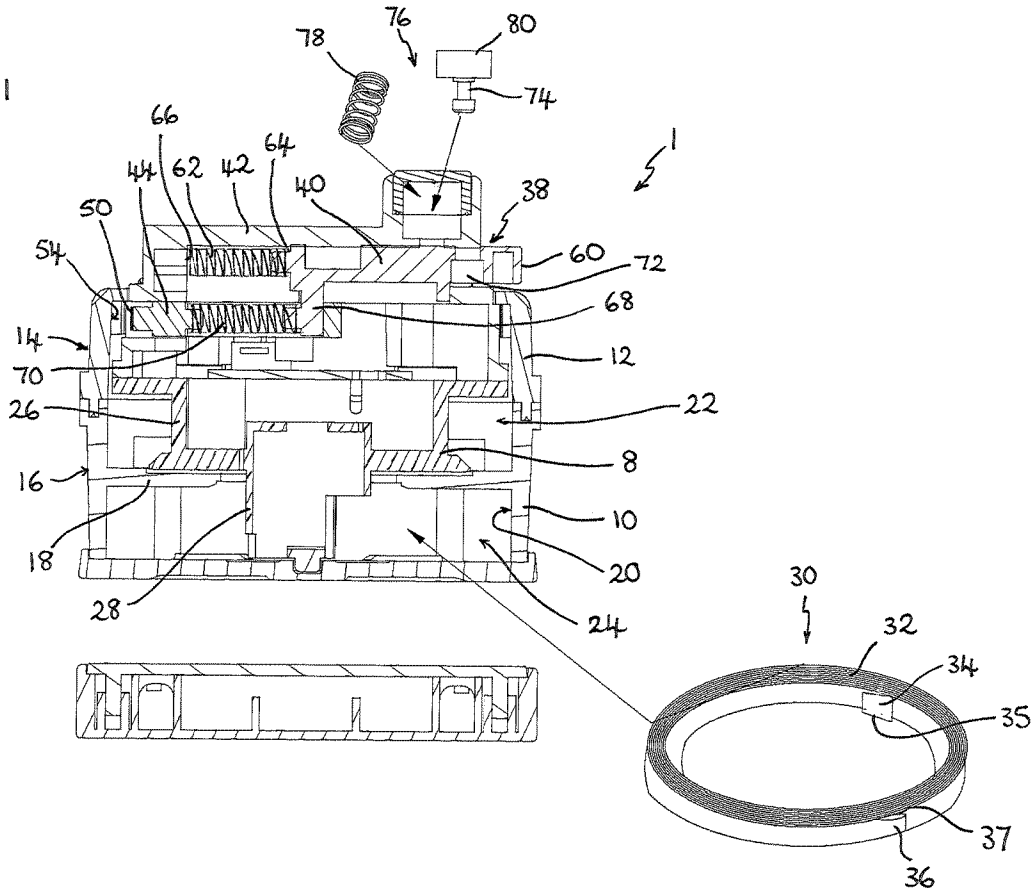
FIG. 2 is a cross-sectional and partially exploded view of the security device of FIG. 1.
Figure 3:
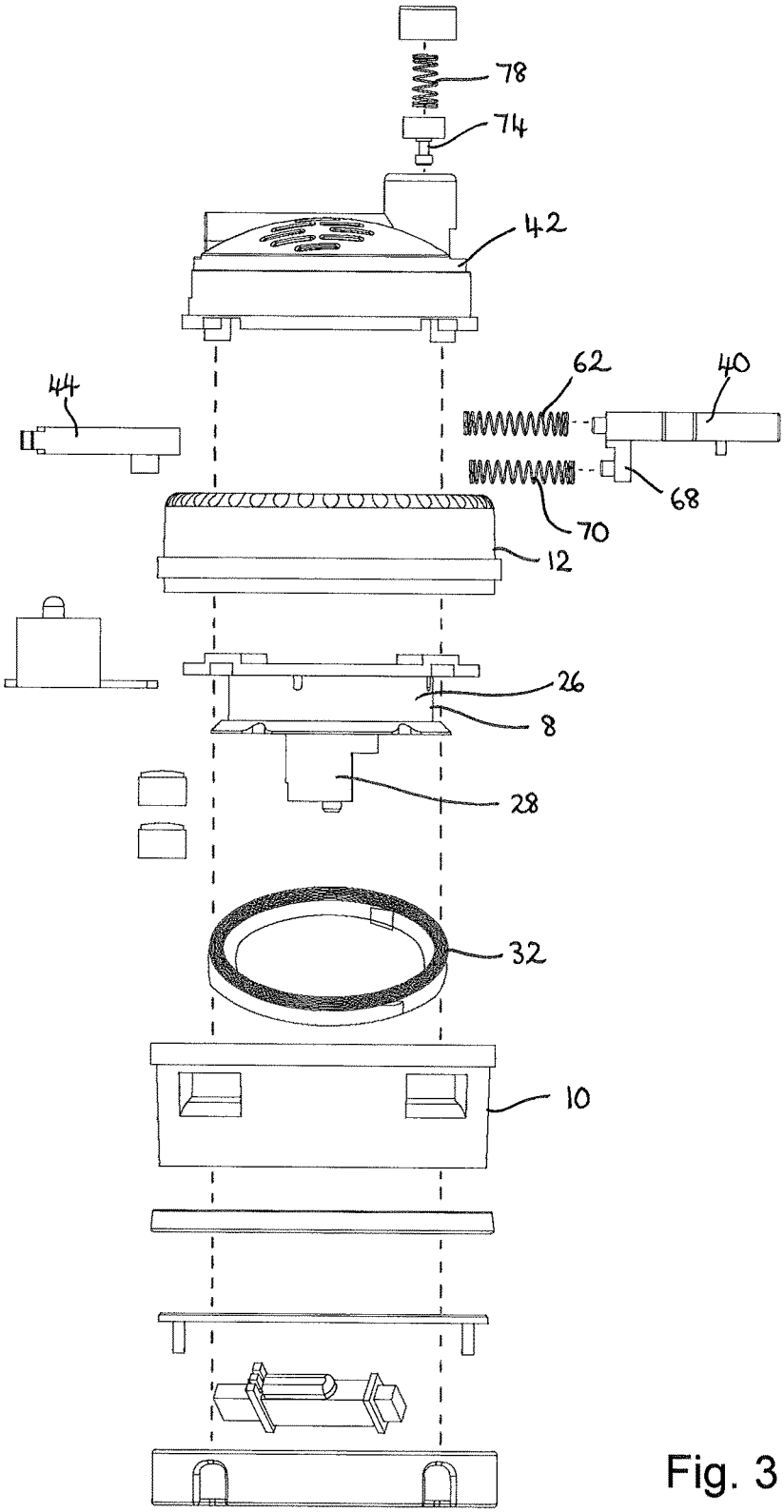
FIG. 3 is an exploded view of the security device of FIG. 1.
Figure 4:
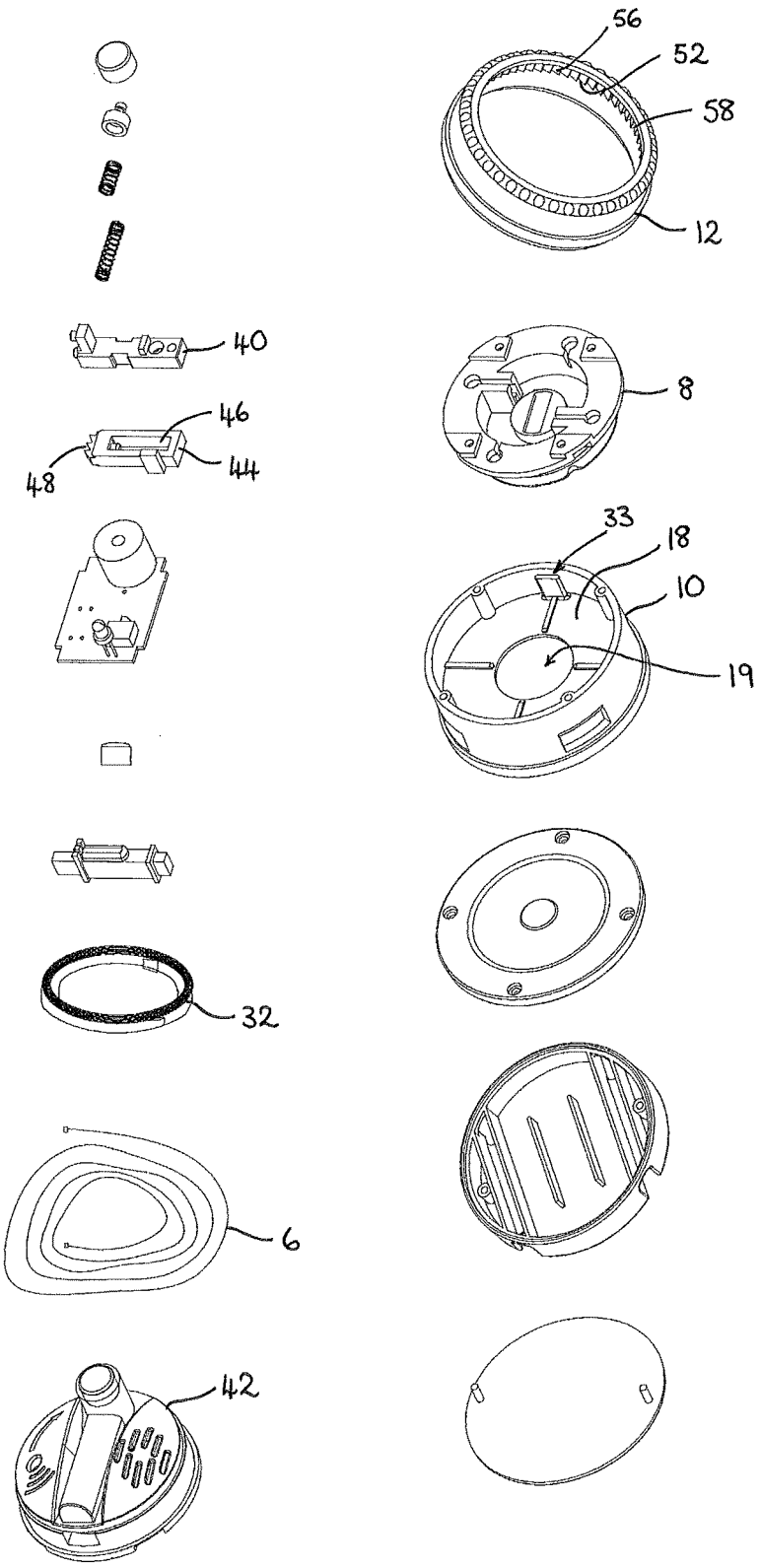
FIG. 4 shows separate components of the security device of FIG. 1.

FIG. 2 shows a cross sectional view of the security device 1. The cables are not shown in this view for clarity. FIGS. 3 and 4 further illustrate main components of the security device 1.

The main body 2 comprises a generally cylindrical lower housing 10 and a generally cylindrical upper housing 12. A first end of the upper housing 12 is secured to a first end of the lower housing 10 such that outer surfaces 14, 16 of the upper and lower housings 12, 10 are substantially continuous, thereby forming the complete housing 9 of the main body 2. A flange 18 projects radially inwards from an internal surface 20 of the lower housing 10, defining a central aperture 19 (shown most clearly in FIG. 4), and dividing the lower housing 10 into an upper portion 22 and a lower portion 24.

The spool means 8 is generally cylindrical and comprises a cable receiving portion 26 having a first outer diameter and a hub portion 28 having a second outer diameter, the second outer diameter being substantially smaller than the first outer diameter. The cable receiving portion 26 and the hub portion 28 are spaced along an axis of rotation of the spool means 8.

The spool means 8 is received in the lower housing 10 and supported by the flange 18. The spool means 8 extends through the aperture 19 such that the cable receiving portion 26 is located in the upper portion 22 of the lower housing 10 and the hub portion 28 is located in the lower portion 24 of the lower housing 10. The spool means 8 is able to rotate with respect to the lower housing 10 in opposite first and second directions about the axis of rotation. Because the spool means 8 is supported by the flange 18, no axle or bearings are required to enable rotation of the spool means 8 with respect to the lower housing 10.

The ends of the cable 6 are secured to the spool means 8 and, as the spool means 8 is rotated in the second direction, the cable 6 is wound around the cable receiving portion 26 of the spool means 8. As such, all of the cable 6 is wound around a single cable receiving portion 26 of the spool means 8. In other embodiments, one or more cables 6 or cable portions may be wound around separate spool means or two or more distinct cable receiving portions of a single spool means. For example, in embodiments comprising two cables, each of the cables may be wound around a separate cable receiving portion of the spool means, or in embodiments comprising four cables, each of the cables may be wound around a different spool means.

Retracting means 30 are connected between the hub portion 28 of the spool means 8 and the internal surface 20 of the lower housing 10. In this embodiment the retracting means 30 is in the form of a flat section torsion or coil spring 32 comprising a flat coil of metal having a first, inner end 34 and a second, outer end 36. The first end 34 of the coil spring 32 is attached to a fixed point on the hub portion 28 of the spool means 8 and the second end 36 of the coil spring 32 is attached to a fixed point on the lower housing 10.

In this example, the first end 34 of the coil spring 32 comprises a portion that is bent through substantially 180° to form a first hook portion 35. Similarly, the second end 36 of the coil spring 32 also comprises a portion that is bent through substantially 180°, to form a second hook portion 37. The hub portion 28 of the spool means 8 comprises a tab (not shown) for receiving and retaining the first hook portion 35 of the coil spring 32. The lower housing 10 comprises a tab 33 projecting from its internal surface 20 for receiving and retaining the second hook portion 37. The tabs 31, 33 and hook portions 35, 37 thereby allow the retracting means 30 to be secured to the spool means 8 and lower housing 10 without the need for separate securing means such as adhesive or screws. This simplifies assembly of the security device 1.

The coil spring 32 acts as a biasing means urging the spool means 8 to rotate in the second direction to wind the cable 6 around the spool means 8. In use, when a user rotates the spool means 8 in the first direction to unwind the cable 6, this rotation causes the coils of the spring 32 to tighten as the first end 34 of the coil moves in a first circumferential direction with respect to the second end 36. The design of the coil spring 32 is such that the coil wants to increase its radius of curvature to relieve the bending stresses in the coil. Accordingly, when the user stops unwinding the cable, the spring 32 provides a biasing force that urges the first end 34 of the coil, attached to the hub portion 28 of the spool means 8, to move in a second, opposite circumferential direction with respect to the second end 36 attached to the lower housing 10. This causes the spool means 8 to rotate in the second direction, thereby winding the cable 6 around the cable receiving portion 26. The cable 6 is, therefore, automatically retracted by the action of the retracting means 30 without requiring a user to manually wind up the cable 6.

In other embodiments the retracting means 30 may be of any suitable type that applies a biasing force to the spool means 8 to cause the spool means 8 to rotate in a direction that causes the cable 6 to wind around the spool means 8. The retracting means 30 may be, for example, a different type of torsional spring or another spring mechanism.

The security device 1 further comprises latching means 38. The latching means 38 comprises an elongate trigger arm 40 movable between a first, unlatched or deactivated position and a second, latched or activated position. The trigger arm 40 is mounted in a trigger housing 42 that is attached to the spool means 8 such that the trigger housing 42 and trigger arm 40 rotate together with the spool means 8. The trigger housing 42 is attached to a top of the spool means 8 such that the trigger housing 42 is at least partially received within the upper housing 12.

The latching means 38 further comprises a ratchet mechanism. A first part of the ratchet mechanism is connected to the trigger arm 40 and a second part of the ratchet mechanism is located on or connected to the upper housing 12. In this embodiment the first part of the ratchet mechanism comprises a generally rectangular pawl member 44 having an elongate central slot 46 (see FIG. 4). Teeth 48 project from a first end 50 of the pawl member 44, each of the teeth 48 having a triangular shape. The teeth 48 each include a straight edge, extending substantially parallel to a longitudinal axis of the pawl member 44, and a sloped edge extending at an angle of about 45° to the longitudinal axis.

The second part of the ratchet mechanism comprises a ratchet wheel or track 52 extending circumferentially around an internal surface 54 of the upper housing 12 (shown most clearly in FIG. 4). The ratchet track 52 comprises a plurality of teeth 56, each having a triangular shape. The teeth 56 each include a straight edge, extending substantially parallel to a radius of the upper housing 12, and a sloped edge extending at an angle of about 45° to the radius. A similarly shaped triangular groove 58 is, thereby, defined between each of the teeth 56.

The trigger arm 40 further comprises a post 68, proximate a second end 64 of the trigger arm 40, which engages in the slot 46 in the pawl member 44. The post 68 is located at the second end of the slot 46 furthest from the first end 50 of the pawl member 44. A compression spring 70 is located between the post 68 and the opposing first end of the slot 46.

A hole 72 is present in the trigger arm 40 proximate its first end 60. The hole 72 is positioned to receive a retaining pin 74 when the trigger arm 40 is in the activated position. The retaining pin 74 is part of a locking mechanism 76 located in trigger housing 42. The locking mechanism 76 further comprises a compression spring 78 located between an internal surface of the trigger housing 42 and a head 80 of the retaining pin 74. The spring 78 acts as a biasing means urging the retaining pin 74 in a direction towards the trigger arm 40 so that the retaining pin 74 engages in the hole 72 as soon as the trigger arm 40 is moved into the activated position. The head 80 of the retaining pin 74 is made from a suitable magnetic material.

In the deactivated position, the first end 60 of the trigger arm 40 projects from a first side of the trigger housing 42. A spring 62, forming a biasing means, is positioned between the second end 64 of the trigger arm 40 and an internal surface 66 of the trigger housing 42. The spring 62 acts to bias the trigger arm 40 in its deactivated position.

When the trigger arm 40 is in the deactivated position the pawl member 44 is held within the trigger housing by means of the post 68 acting against the second end of the slot 46. In this position the teeth 48 are disengaged from the ratchet track 52, and the spool means 8 is free to rotate in both the first and second directions with respect to the lower housing 10. The trigger arm 40 is held in the deactivated position by means of the spring 62.

To activate the security device 1, the first end 60 of the trigger arm 40 is pressed into the trigger housing 42 against the biasing force of the spring 62. Once the first end 60 of the trigger arm 40 has been pressed far enough, the retaining pin 74 engages in the hole 72 to retain the trigger arm 40 in this position.

Furthermore, as the trigger arm 40 is moved to the activated position the post 68 presses against a first end of the spring 70, which transfers the force to the first end of the slot 46. This moves the pawl member 44 such that the teeth 48 at the first end 50 of the pawl member 44 project from the trigger housing 42 and engage with the ratchet track 52 on the upper housing 12. The stiffness of the spring 70 is such that there is no significant compression of this spring as the trigger arm 40 and pawl member 44 move into the activated position. The spring 70 then acts to provide a biasing force to the pawl member 44 to retain the teeth 48 in engagement with the ratchet track 52.

With the teeth 48 of the pawl member 44 engaged with the grooves 58 of the ratchet track 52, the spool means 8 can only rotate in the second direction with respect to the upper housing 12, so as to wind the cable 6 around the spool means 8. The spool means 8 is prevented from rotating in the first direction so that the cables 6 cannot be unwound from the spool means 8.

To deactivate the security device 1, a magnet (not shown) is held near the top of the device 1 such that a magnetic force is applied to the head 80 of the retaining pin 74 to draw the pin 74 from the hole 72 against the force of the spring 78. As soon as the retaining pin 74 is withdrawn from the hole 72, the spring 62 urges the trigger arm 40 into the deactivated position. In some embodiments, it may be necessary to initially press the trigger arm 40 against the force of the spring 62 to fully disengage the pin 74 from the hole 72, before the spring 62 then urges the trigger arm 40 into the deactivated position.

As the trigger arm 40 moves to the deactivated position, the post 68 pushes against the second end of the slot 46 in the pawl member 44, thereby pulling the pawl member 44 into the trigger housing 42 and disengaging the teeth 48 from the ratchet track 52.

The use of the security device 1 to deter theft of an article will now be described.

In use, with the latching means 38 in the deactivated position, the guide member 4 is drawn away from the main body 2 so as to unwind the cable 6 from the spool means 8. The loops of cable 6 are then placed around an article to be tagged. Once any tension on the cable 6 has been released, the retracting means 30 causes the cable 6 to be automatically wound up around the spool means 8. This draws the guide means 4 towards the main body 2 and, at least partially, tightens the loops of cable 6 around the article, without requiring a user to manually wind up the cable 6.

The latching means 38 are then activated. Once activated, a user may choose to further tighten the cable 6 by rotating the spool means 8 in the second direction. The engagement of the pawl means 44 with the ratchet track 52 means that the spool means 8 cannot be rotated in the opposite direction, so that the loops of cable 6 cannot be loosened and removed from around the article without the security device 1 being disabled or deactivated.

The article can then be displayed in a retail store, for example. If someone tries to remove the tagged article from the store, or tries to remove the tag from the article, an alarm will sound. The presence of the security device 1 around the article, therefore, deters theft of the article.

When a customer purchases the article, the security device 1 must be disabled or deactivated and removed from the article. This is achieved by applying a magnetic force to the locking mechanism as described above.

When the security device 1 is disabled, the cable 6 can be unwound from the spool means 8 and can be removed from around the article. Once any tensile forces have been removed from the cable 6, the retracting means 30 automatically wind the cable 6 around the spool means 8 such that a user does not need to manually wind up the cable 6 before storing the security device 1 for future use.

In some embodiments of the present invention it is desirable if the retracting means 30 is arranged or designed such that the retracting means 30 does not cause the cable 6 to be wound around the spool means 8 when the trigger arm 40 is in the activated position. This may be achieved by designing the retracting means 30 such that the rotational force applied to the spool means 8 by the retracting means 30 is not sufficient to cause rotation of the spool means 8 when the latching means 38 is engaged, for example when the teeth 48 are engaged with the ratchet track 52. This prevents an undesirably large compressive force being applied to an article by the cable 6 once the security device 1 is activated.

The inclusion of the automatic retracting means 30 in the security device 1 of the present invention, therefore, means that it is not necessary for a user to manually wind up the cable 6 either when the security device 1 is placed around an article or when the security device 1 is to be stored. The security device 1 of the present invention, therefore, provides an improved security device for preventing theft of an object from a retail space.

The invention claimed is:

1. A security device for deterring theft of an object, the security device comprising:

a housing having an internal surface;

a loop of cable extending from the housing for placement around said object;

a spool rotatably mounted on the housing, the spool comprising a cable receiving portion and a hub portion spaced along an axis of rotation of the spool, the loop of cable being attached at first and second ends to the cable receiving portion such that, in use, rotation of the spool in a first direction with respect to the housing causes said cable to unwind from the spool permitting placement of the loop of cable around said object, and rotation of the spool in a second, opposite direction causes said cable to be wound around the spool thereby tightening the loop of cable around said object;

a latching mechanism movable between a first position in which the spool is able to rotate freely in both the first and second directions, and a second position in which the spool is able to rotate in the second direction but is prevented from rotating in the first direction;

an alarm, the alarm being configured to be activated when the latching mechanism is in the second position; and a retracting device arranged to apply a biasing force to the spool to urge the spool to rotate in said second direction when the latching mechanism is in the first position, the retracting device being connected to the hub portion of the spool, wherein the latching mechanism comprises a ratchet mechanism including a ratchet track that is located on the internal surface of the housing and a pawl member that is secured to and rotatable with the spool, the pawl member being arranged to engage with the ratchet track when the latching mechanism is in the second position.

2. The security device as claimed in claim 1, the security device comprising two loops of cable extending from the housing for placement around said object.

3. The security device as claimed in claim 1, wherein the housing comprises a flange, the flange being positioned between a first portion of the housing and a second portion of the housing, and wherein the spool is supported by said flange for rotation with respect to the housing.

4. The security device as claimed in claim 3, wherein the flange defines an aperture and the spool extends through the aperture such that the cable receiving portion is located in the first portion of the housing and the hub portion of the spool means is located in the second portion of the housing.

5. The security device as claimed in claim 1, wherein the retracting device is attached to the hub portion of the spool and to the housing.

6. The security device as claimed in claim 5, wherein the retracting device comprises a first end portion attached to the spool and a second end portion attached to the housing, and wherein a shape of a part of the spool is configured to retain the first end of the retracting device and a shape of a part of the housing is configured to retain the second end of the retracting device.

7. The security device as claimed in claim 6, wherein the first end portion comprises a first hook portion and the second end portion comprises a second hook portion, the hub portion of the spool comprises a tab configured to receive the first hook portion, and the housing comprises a tab configured to receive the second hook portion.

8. The security device as claimed in claim 1, wherein the latching mechanism comprises a biasing device arranged to apply a biasing force to urge the pawl member into engagement with the ratchet track and wherein the biasing force of the retracting device is less than the biasing force of said biasing device of the latching mechanism.

9. The security device as claimed in claim 1, wherein the retracting device is arranged to apply a biasing force to rotate the spool in the second direction when the latching mechanism is in the first or the second position.

10. The security device as claimed in claim 1, wherein the retracting device comprises a spring.

11. The security device as claimed in claim 1, wherein the retracting device comprises a torsional spring.

12. The security device as claimed in claim 1, wherein the retracting device comprises a flat section coil spring.

13. The security device as claimed in claim 1, further comprising a locking mechanism, the locking mechanism being movable between an unlocked position and a locked position, wherein the locking mechanism is only movable into the locked position when the latching mechanism is in the second position and in the locked position the locking mechanism prevents the latching mechanism returning to the first position.

14. The security device as claimed in claim 13, wherein the locking mechanism is configured to automatically move into the locked position when the latching mechanism is moved into the second position.

15. The security device as claimed in claim 1, wherein the pawl member is connected to a trigger arm mounted in a trigger housing, both the trigger arm and the trigger housing rotating with the spool, and wherein when the latching mechanism is in the first position the pawl member is held within the trigger housing and when the latching mechanism is in the second position the pawl member projects from the trigger housing.

* * * * *